US007389911B2

(12) United States Patent
Ruocco

(10) Patent No.: US 7,389,911 B2
(45) Date of Patent: Jun. 24, 2008

(54) MAILBOX EXTENSION APPARATUS

(76) Inventor: Joseph Francis Ruocco, 14 Lindsay Ter., Saugus, MA (US) 01906-3163

( * ) Notice: Subject to any disclaimer, the term of this patent is extended or adjusted under 35 U.S.C. 154(b) by 0 days.

(21) Appl. No.: 11/401,132

(22) Filed: Apr. 10, 2006

(65) Prior Publication Data

US 2007/0235515 A1 Oct. 11, 2007

(51) Int. Cl.
*A47G 29/12* (2006.01)

(52) U.S. Cl. ..... 232/39; 248/128; 248/298.1; 248/424

(58) Field of Classification Search ..... 232/39, 232/17; D99/32; 248/128, 429, 424, 121, 248/298.1, 257, 265, 269
See application file for complete search history.

(56) References Cited

U.S. PATENT DOCUMENTS 1,731,682 A * 10/1929 Pendergrass ..... 248/128
2,279,622 A * 4/1942 Hurd ..... 248/145
3,289,988 A * 12/1966 McKenney et al. ..... 248/145
3,497,078 A * 2/1970 Nash ..... 211/79
4,496,123 A * 1/1985 Laramie ..... 248/121
4,821,952 A * 4/1989 Deciutiis ..... 232/17
D371,884 S * 7/1996 Esgro ..... D99/29
6,161,756 A * 12/2000 Upton ..... 232/39
6,164,527 A * 12/2000 Garey ..... 232/39
6,543,680 B1 * 4/2003 McCormack ..... 232/39
6,988,655 B1 * 1/2006 Riccio ..... 232/39

* cited by examiner

*Primary Examiner*—William L. Miller
(74) *Attorney, Agent, or Firm*—Raymond M. Galasso; David O. Simmons; Galasso & Associates LP

(57) ABSTRACT

A mailbox mounting apparatus comprises three elongated members, a mounting bracket and a mailbox attachment bracket. A first one of the elongated members is movably attached to a second one of the elongated members for enabling the first and second elongated members to be moved between a respective stacked configuration and a respective extended configuration. The second one of the elongated members is movably attached to a third one of the elongated members for enabling the second and third elongated members to be moved between a respective stacked configuration and a respective extended configuration. The mounting bracket is attached to the first one of the elongated members. The mounting bracket is specifically configured for being attached to a mailbox support structure. The mailbox attachment bracket is attached to a third one of the elongated members. The mailbox attachment bracket is specifically configured for mating with a base portion of a mailbox.

4 Claims, 3 Drawing Sheets

MAILBOX EXTENSION APPARATUS

FIELD OF THE DISCLOSURE

The disclosures made herein relate generally to mailboxes mounting apparatuses and, more particularly, to mailbox mounting apparatuses that enable the mailbox to be selectively positioned.

BACKGROUND

It is important for a resident to be able to access their mailbox in order to retrieve their mail. Likewise, it is also important that the mail carrier be able to access the mailbox in order to deliver the mail in a timely manner. Without the ability for a resident and mail carrier to have access to the mailbox, the intended mail recipient may not be able to receive important information they would have otherwise received.

There are many issues regarding mailboxes and the typical location of a mailbox. Mailboxes are often damaged by snowplows or other vehicles and are often times inaccessible if snow has accumulated around them. Because a mailbox is typically attached to a post or equivalent structure in a fixed manner, it is not readily moved to gain access. This sometimes makes it difficult or even dangerous for mail carriers to reach the mailbox in order to deliver the mail. If there is sufficient difficulty or risk for the mail carrier to deliver the mail, they may not be able to deliver the mail to the intended recipient. For example, accumulated snow makes it a challenge for the mail recipient to retrieve their mail, especially if the recipient is elderly or physically handicapped. As a result, the intended recipient may not receive vital mailed information. The typical solution for this issue is for the resident to shovel the area around the mailbox in order for it to be accessible by them and the mail carrier. However, this is very inconvenient and in the case of the elderly or physically handicapped, it can be impossible, unsafe and/or healthy.

Therefore, an apparatus that allows a mailbox to be selectively moved from a retracted position to an extended position in order to facilitate easy access when the mailbox is not readily and/or safely accessible and that allows the mailbox to be readily moved back to the retracted position would be useful and advantageous.

SUMMARY OF THE DISCLOSURE

Embodiments of the present invention provide for a distance between a mailbox and an adjacent roadway to be selectively varied. More specifically, embodiments of the present invention allow a mailbox to be selectively extended between a plurality of positions with respect to the structure to which it is mounted. This movable mounting arrangement facilitates inserting and retrieving mail from the mailbox when obstacles such as, for example, snow require extended reach to gain access to the mailbox.

In one embodiment of the present invention, a mailbox mounting apparatus comprises a plurality of elongated members, a mounting bracket and a mailbox attachment bracket. Adjacent pairs of the elongated members are movably attached to each other for enabling the adjacent pairs of elongated members to be moved between a respective retracted configuration and a respective extended configuration. The mounting bracket is attached to a first one of the elongated members. The mounting bracket is specifically configured for being attached to a mailbox support structure. The mailbox attachment bracket is attached to a second one of the elongated members. The mailbox attachment bracket is specifically configured for mating with a base portion of a mailbox.

In another embodiment of the present invention, a mailbox mounting apparatus comprises three elongated members, a mounting bracket and a mailbox attachment bracket. A first one of the elongated members is slideably attached to a second one of the elongated members for enabling the first and second elongated members to be moved between a respective stacked configuration and a respective extended configuration. The second one of the elongated members is slideably attached to a third one of the elongated members for enabling the second and third elongated members to be moved between a respective stacked configuration and a respective extended configuration. The mounting bracket is attached to the first one of the elongated members. The mounting bracket is specifically configured for being attached to a mailbox support structure. The mailbox attachment bracket is attached to a third one of the elongated members. The mailbox attachment bracket is specifically configured for mating with a base portion of a mailbox.

In another embodiment of the present invention, a mailbox assembly comprises a plurality of elongated members and a mailbox. Adjacent pairs of the elongated members are movably attached to each other for enabling the adjacent pairs of elongated members to be moved between a respective retracted configuration and a respective extended configuration. The mailbox has exterior walls and a floor. The floor and/or a portion of one of the exterior walls are attached to an outermost one of the elongated members.

Turning now to specific aspects of the present invention, in at least one embodiment, a mounting bracket is attached to a first outermost one of the elongated members and the mounting bracket is specifically configured for being attached to a mailbox support structure.

In at least one embodiment of the present invention, a mailbox attachment bracket is attached to a second outermost one of the elongated members and the mailbox attachment bracket is specifically configured for mating with a base portion of a mailbox.

In at least one embodiment of the present invention, means for enabling sliding is provided between the adjacent pairs of the elongated members.

In at least one embodiment of the present invention, the means includes a slot formed in a first elongated member of each one of the adjacent pairs of elongated members and an engagement member attached to a second elongated member of each one of the adjacent pairs of elongated members.

In at least one embodiment of the present invention, the engagement member of each one of the adjacent pairs of elongated members extends into engagement with the respective slot.

In at least one embodiment of the present invention, the adjacent pairs of elongated members are slideably attached to each other for enabling the adjacent pairs of elongated members to be moved between the respective retracted configuration and the respective extended configuration.

In at least one embodiment of the present invention, movement between the retracted configuration and the extended configuration is effectively constrained along a single longitudinal reference axis.

These and other objects, embodiments advantages and/or distinctions of the present invention will become readily apparent upon further review of the following specification and associated drawings.

DETAILED DESCRIPTION OF THE DRAWING FIGURES

Figure 1:
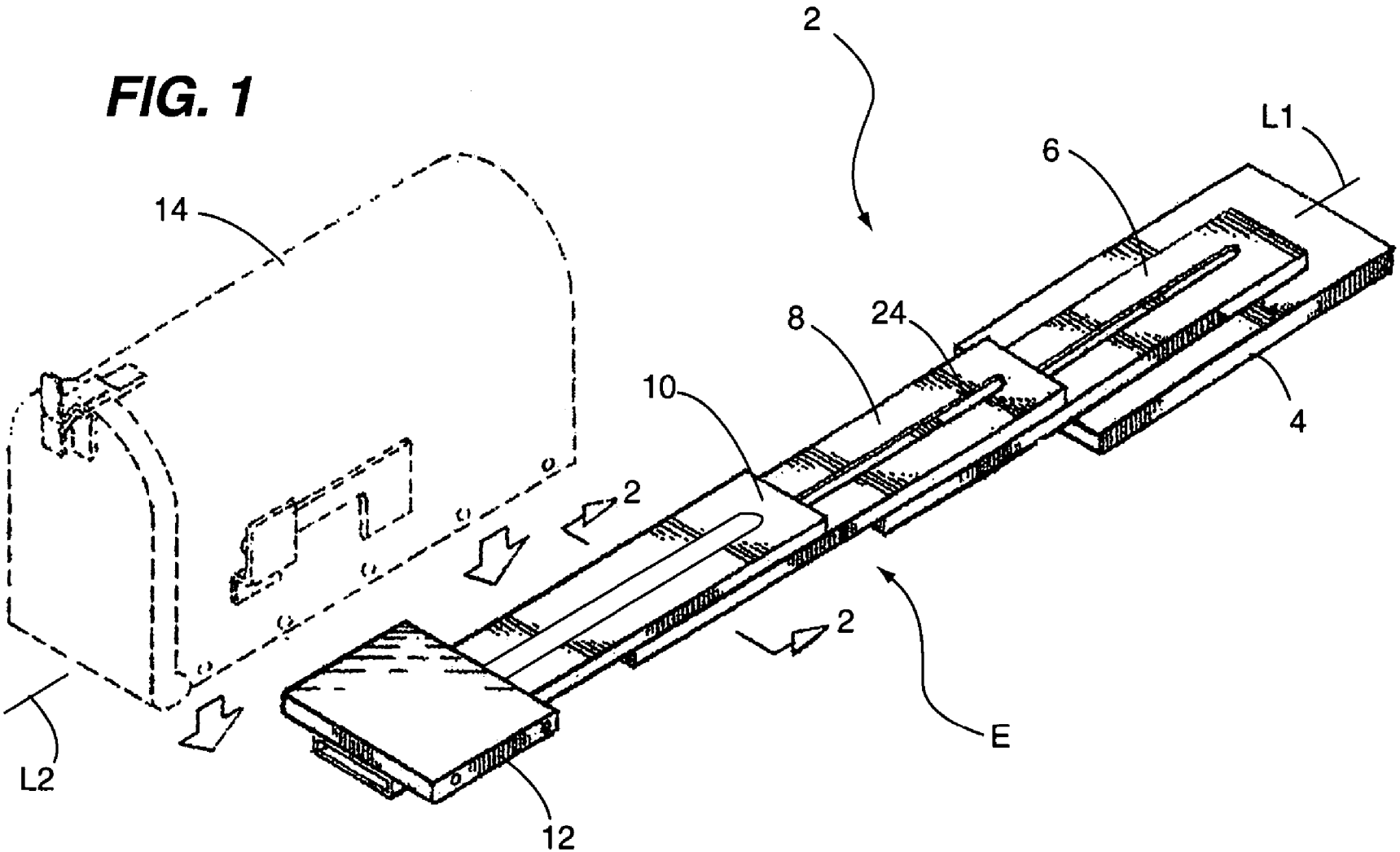
FIG. 1 depicts a mailbox extension apparatus in accordance with an embodiment of the present invention, which is in an extended configuration.
Figure 2:
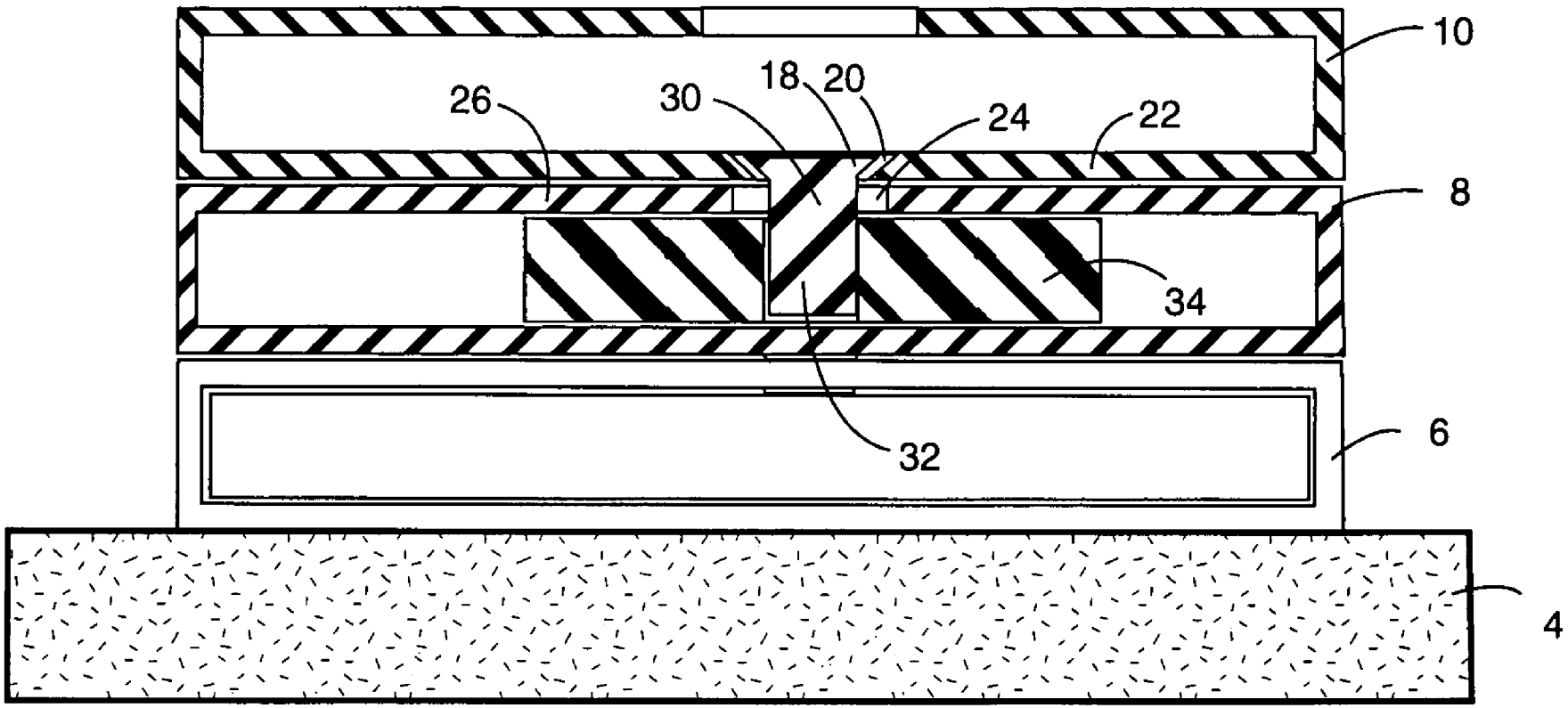
FIG. 2 is a cross-sectional view taken along the line 2-2 in FIG. 1.
Figure 3:
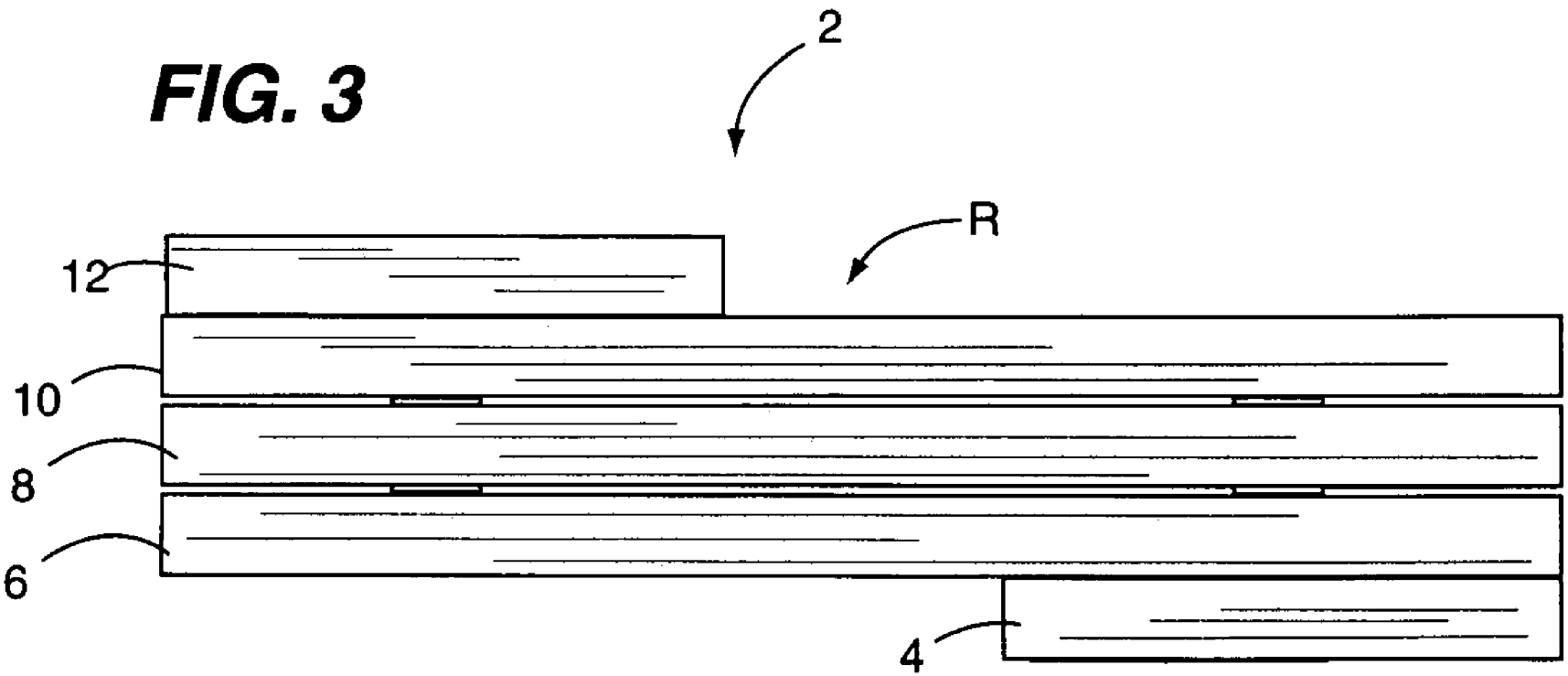
FIG. 3 shows the mailbox extension apparatus of FIG. 1 in a retracted orientation.

FIGS. 1-3 depict various aspects of an embodiment of an apparatus configured for enabling a mailbox to be selectively moved to a variety of different mounted positions. This apparatus is referred to herein as the mailbox extension apparatus 2. The mailbox extension apparatus 2 allow easier access to a mailbox when inclement weather such as snow prevents easy access, thereby enhancing safety and convenience to both the mail recipient and the mail carrier.

The mailbox extension apparatus 2 includes a mounting bracket 4, a first elongated member 6, a second elongated member 8, a third elongated member 10, and a mailbox attachment bracket 12. The mounting bracket 4 is configured for being attached to a mailbox support structure such as, for example, a wood or metal post by means such as, for example, threaded fasteners or nails. The first elongated member 6 is attached to the mounting bracket 4. The second elongated member 8 is slideably attached to the first elongated member 6. The third elongated member 10 is slideably attached to the second elongated member 8. The slideable interconnection enables the elongated members (6, 8, 10) to be moved between an extended configuration E (FIG. 1) and a retracted configuration R (FIG. 3). The mailbox attachment bracket 12 is attached to the third elongated member 10, thereby allowing mounting of a mailbox 14 to the mailbox extension apparatus 2.

The mounting bracket 4 is attached to the mailbox post or stand, thus providing a means for attachment of the mailbox extension apparatus to the mailbox post or stand. The elongated members (6, 8, 10) are in a stacked arrangement with the second elongated member 8 slideably connected between the first elongated member 6 and the third elongated member 10. In this manner, the first elongated member 6 is a first outermost elongated member and the third elongated member 10 is a second outermost elongated member. The second elongated member 8 is slideably movable respect to the first elongated member 6 and the third elongated member 10 is slidably movable respect to the second elongated member 8. As depicted in FIG. 1, the elongated members (6, 8, 10) are slideable along a reference axis L1 that extends generally parallel with a longitudinal axis L2 of the mailbox 14. A skilled person will appreciate that any number of elongated members may be connected in such a slideable manner and integrated into a mailbox extension apparatus in accordance with the present invention to accommodate a desired extension length.

The mounting bracket 4 is attached to the mailbox post or stand with mounting holes that are of a standard size and placement for mailbox 14 installations. The mounting bracket 4 is attached with hardware fasteners, but alternate methods of attachment include, but are not limited to, welding, mortar, or epoxy. As depicted, a bottom portion of the first elongated member 6 is mounted directly to a top portion of the mounting bracket 4. Such an attachment approach includes, but is not limited to, hardware fasteners, epoxy, or welding. Attachment of the first elongated member 6 to the mounting bracket 4 does not interfere with the ability of the second elongated member 6 to slide freely.

In the depicted embodiment, the elongated members (6, 8, 10) are slideable with respect to each other through use of a slot-screw arrangement. A tapered slot 20 is provided in the bottom wall 22 of the third elongated member 10 and a clearance hole 24 is provided in a top wall 26 of the second elongated member 8. A head 28 of a flat head screw 30 is engaged in the tapered slot 20 with a thread portion 32 extending through the clearance hole 24 and into threaded engagement with a hole in a support member 34. Through this arrangement, the third elongated member 10 is slideable along the longitudinal axis L2 with respect to the second elongated member 8. A plurality of such screw-slot engagements is preferably provided to limit movement of the elongated members (6, 8, 10) to linear movement. The first elongated member 6 and the second elongated member 8 are similarly configured for enabling the second elongated member 8 to be slideable along the longitudinal axis L2 with respect to the first elongated member 6.

A skilled person will appreciate other known means for enabling the elongated members (6, 8, 10) to be extendably (e.g., slideably) interconnected. For example, the elongated members (6, 8, 10) may be interconnected with wheels or pins that are in movable engagement with slots, elongated members, or cut-outs or other structural elements. The key functional requirements are selective extension and robust interconnection between elongated members (6, 8, 10). Furthermore, a skilled person will appreciate that the elongated members (6, 8, 10) may be interconnected in a telescoping manner as opposed to a stacked and slideable manner.

The mailbox attachment bracket 12 is attached to the third elongated member 10. The mailbox attachment bracket 12 has standard size holes in a standard pattern to facilitate attaching the mailbox 14 to it and is sized and shaped to mate with a base portion of the mailbox 14 (e.g., a conventional mailbox). Accordingly, the mailbox attachment bracket 12 is specifically configured for mating with a base portion of a mailbox.

In the preceding detailed description, reference has been made to the accompanying drawings that form a part hereof, and in which are shown by way of illustration specific embodiments in which the present invention may be practiced. These embodiments, and certain variants thereof, have been described in sufficient detail to enable those skilled in the art to practice embodiments of the present invention. It is to be understood that other suitable embodiments may be utilized and that logical, mechanical, chemical and electrical changes may be made without departing from the spirit or scope of such inventive disclosures. To avoid unnecessary detail, the description omits certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A mailbox mounting apparatus, comprising:

a plurality of elongated members in stacked configuration, wherein adjacent pairs of said elongated members are movably attached to each other for enabling said adjacent pairs of elongated members to be moved between a respective retracted configuration and a respective extended configuration;

a mounting bracket attached to a first one of said elongated members, wherein the mounting bracket is specifically configured for being attached to a mailbox support structure; and a mailbox attachment bracket attached to a second one of said elongated members, wherein the mailbox attachment bracket is specifically configured for mating with a base portion of a mailbox;

means for enabling sliding provided between adjacent pairs of said elongated members, said means includes a screw-slot formed in one member of each one of said adjacent pairs of elongated members and a screw attached to the other member of each one of said adjacent pairs of elongated members, wherein a head of the screw extends into engagement with the respective screw-slot.

2. The apparatus of claim 1 wherein:

movement between the retracted configuration and an extended configuration is effectively constrained along a single longitudinal reference axis.

3. A mailbox mounting apparatus, comprising:

three elongated members, wherein a first one of said elongated members is slidably attached to a second one of said elongated members by way of a screw-slot and a flat head screw for enabling said first and second elongated members to be moved between a respective stacked configuration and a respective extended configuration and wherein the second one of said elongated members is slidably attached to a third one of said elongated members for enabling said second and third elongated members to be moved between a respective stacked configuration and a respective extended configuration;

a mounting bracket attached to the first one of said elongated members, wherein the mounting bracket is specifically configured for being attached to a mailbox support structure; and a mailbox attachment bracket attached to the third one of said elongated members, wherein the mailbox attachment bracket is specifically configured for mating with a base portion of a mailbox.

4. The apparatus of claim 1 wherein:

movement between the respective retracted configuration and the extended configuration is effectively constrained along a single longitudinal reference axis.

* * * * *